US005577734A

United States Patent [19]

Conroy

[11] Patent Number: 5,577,734

[45] Date of Patent: Nov. 26, 1996

[54] SUSPENDED TARGET SYSTEM

[76] Inventor: Patrick J. Conroy, 311 S. Huron Ave., Harbor Beach, Mich. 48441

[21] Appl. No.: 302,612

[22] Filed: Sep. 7, 1994

[51] Int. Cl.[6] ..... F41J 3/00

[52] U.S. Cl. ..... 273/407

[58] Field of Search ..... 273/406, 407, 273/408, 403, 404

[56] References Cited

U.S. PATENT DOCUMENTS

| | | | |
|---|---|---|---|
| 1,886,562 | 11/1932 | LeFever | 273/404 X |
| 2,069,822 | 2/1937 | Douglas | 273/404 |
| 3,519,272 | 7/1970 | De Vogelaere | 273/406 X |
| 3,720,411 | 3/1973 | De Vogelaere | 273/404 |
| 3,762,709 | 10/1973 | Roloff | 273/404 |
| 4,491,328 | 1/1985 | Meyer | 273/403 |
| 4,813,684 | 3/1989 | Bruno | 273/403 |

*Primary Examiner*—William H. Grieb
*Attorney, Agent, or Firm*—Young & Basile, P.C.

[57] ABSTRACT

A target system utilizes a plurality of flexible sheets as a primary projectile arresting structure. Means are provided to hold the sheets spaced apart to form a set of parallel, co-extensive layers, and to suspend the target system from above. With this configuration the layers are capable of halting a projectile through a combination of phenomena, including the transfer of kinetic energy from the projectile as it pushes against the mass of the target itself, causing a backward and forward rocking motion. The layers may be composed of a lightweight material, and the means used to hold the sheets spaced apart may form a box-like structure when brought together, with the sheets of flexible material being foldable for total inclusion therewithin for storage and portability. The box-like structure may further include a separate compartment to house equipment associated with the firing of a projectile, such as a bow and arrows. In the preferred embodiment, each flexible sheet forms a continuous web surrounding upper and lower dowels, thus enabling a user to shift the sheets in relation to one another to misalign previously formed punctures. The webs of sheet material may be manually moveable or, alternatively, a motorized driving means may be employed to move the sheets automatically, including via remote control.

26 Claims, 2 Drawing Sheets

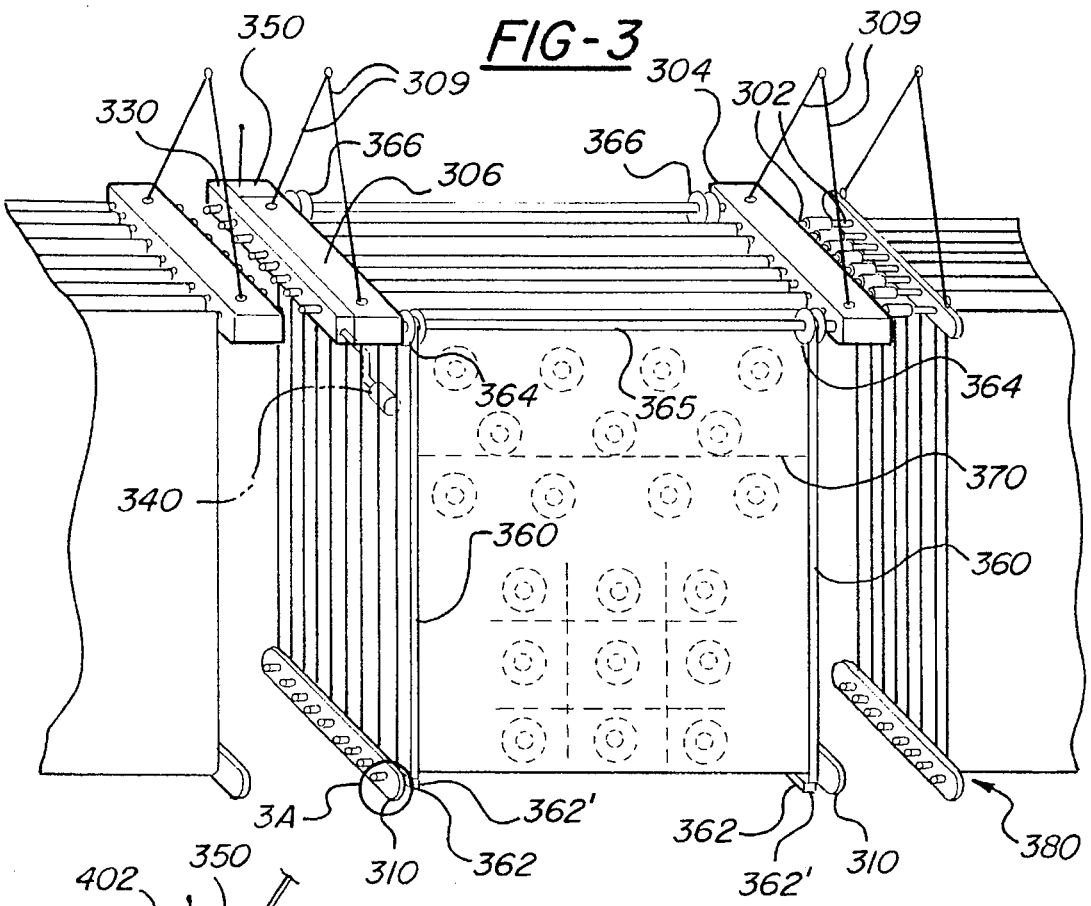
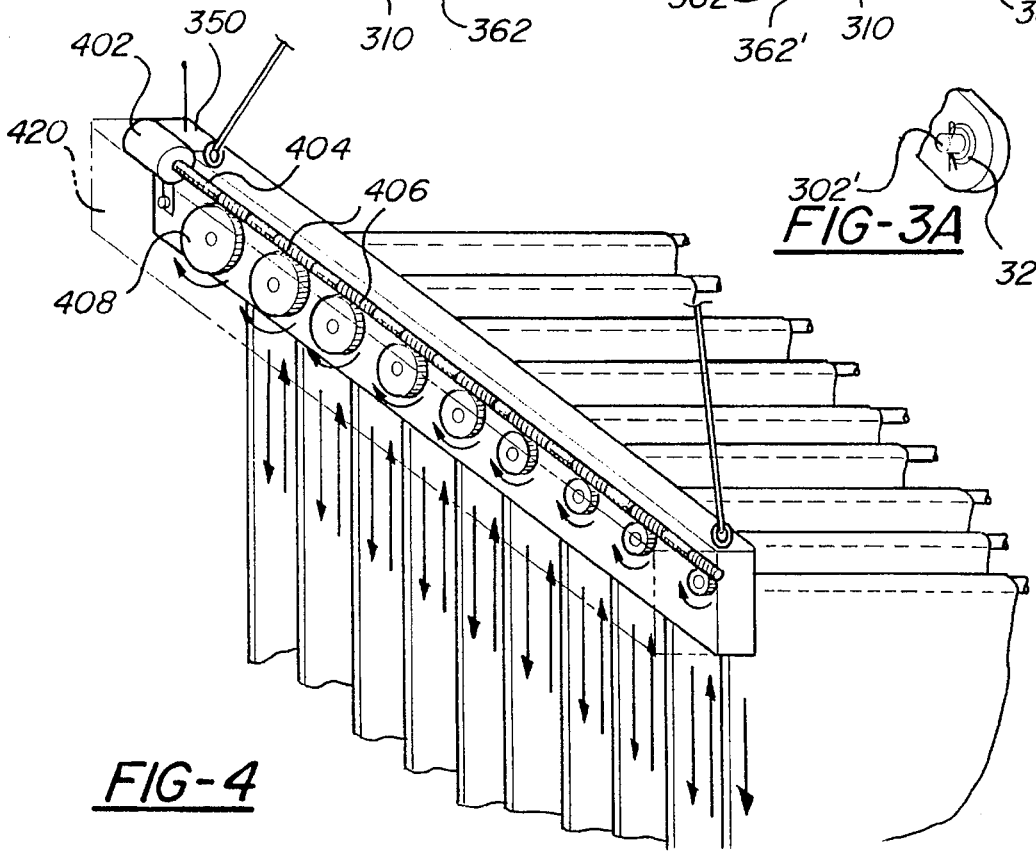
FIG-3A
FIG-4

SUSPENDED TARGET SYSTEM

FIELD OF THE INVENTION

The present invention relates generally to target systems and, in particular, to a suspended target system which uses a plurality of spaced-apart co-extensive sheets of flexible material as a primary projectile arresting structure.

BACKGROUND OF THE INVENTION

A target capable of stopping a medium-force projectile such as an arrow presents conflicting requirements. On the one hand, it is desirable to have a lightweight structure to ease portability, and so forth, but on the other hand, lightweight materials are typically only capable of stopping low-force projectiles. These conflicting demands are manifest in the prior art, which show either lightweight, portable targets which are not suitable for archery practice, and heavy, substantial targets capable of stopping such projectiles, but which are lacking in portability. Indeed, typical archery targets use bales of hay, which present a fire hazard, particularly when used indoors, and from which arrows are difficult to withdraw.

Examples of lightweight, portable targets which are not capable of stopping medium-force projectiles include U.S. Pat. No. 1,886,562, entitled "Target," which discloses a box-like structure comprising a collapsible frame in conjunction with a removable target member and a flexible backstop. However, the target member is cardboard, and the system is limited for use in connection with air rifles and other low force delivery devices. U.S. Pat. No. 3,720,411, "Portable Target to Receive, Contain and Prevent Splashback of Medium Velocity Projectiles," includes features which ease portability, but, as the title suggests, is constrained to projectiles of low force and medium velocity, in the range of about 600 ft. per second, including those delivered by air rifles, pellet guns, and so forth. The projectile arresting structure is, however, of a multilayered construction.

U.S. Pat. No. 3,519,272, "Marksmanship Training Target," teaches a box-like enclosure which may be separated to expose a roll of target paper and a shield to halt the flight of an incoming projectile. Due to the limited number of projectile-stopping layers, however, this invention is also limited to low-force projectiles. Preferably, the projectile is in the form of specially designed ammunition utilizing a modified slug which will act as a normal bullet when fired, but which will become spent after passing through the target paper, then drop into the case after striking a backstop suspended behind the target. This invention is limited to specially designed ammunition and circumstances, the upper portion being held above the base using a plurality of telescoping legs, which, if required to absorb the force energy of a projectile of considerably more substance, could cause the entire structure to fall backwards when hit.

Targets capable of stopping medium-force projectiles, including arrows, are conventionally much more substantial and although movable in some cases, are not collapsible and are therefore only marginally portable. For example, U.S. Pat. No. 4,491,328, "Target Having Shiftably Movable Target Structure," is suitable for use as an archery target, but is not readily portable. Although the structural elements are secured to each other by means of separable fasteners, their purpose is mainly for convenience in initial assembly, shipping and so forth, and they are not intended to be broken down between uses. A useful feature of this target system concerns the fact that certain of its layers are shiftable with respect to one another so as to create a fresh composite of layers between uses. This shiftability misaligns punctures formed through the entry of projectiles previously received.

U.S. Pat. No. 4,813,684, "Target for Bow and Arrow," teaches a stack of cardboard strips held within a frame between upper and lower sections which may be compressed relative to one another to enhance the target's arrow stopping capability. Although the target is mounted on a stand having wheels for movability, this system is not readily collapsible for transportation over longer distances. Additionally, the impact of a volley of arrows might cause such a target to pivot about the wheels, thereby becoming misaligned with respect to the archer.

SUMMARY OF THE INVENTION

The present invention provides a target system having a primary projectile arresting structure in the form of a plurality of flexible sheets, including means to hold the sheets spaced apart to form a set of parallel, co-extensive layers, and means to suspend the target system from above, whereby the layers halt a projectile fired substantially transversely with respect thereto. The target system is especially suited to shafted projectiles such as arrows, but is not limited in this regard.

The layers are capable of halting a projectile through a combination of phenomena, including the transfer of kinetic energy from the projectile into a swinging motion of the suspended target system layers slow or halt the projectile at least in part by the transfer of kinetic energy from the projectile to flexible motion of the sheets and target frame members. As such, the layers may be composed of a lightweight material such as plastic, preferably polyethylene. In addition, the means used to hold the sheets spaced may form a box-like structure when brought together, with the sheets of flexible material being foldable for total inclusion therewithin for easier storage and portability. The box-like structure may further include a separate compartment to house equipment related to the firing of a projectile, such as a bow and/or arrows, or pellet or BB rifle.

In the preferred embodiment, each sheet of flexible material is in the form of a continuous web which surrounds an upper dowel and a lower dowel, thus enabling a user of the target system to misalign punctures in the layers created by a previous firing of a projectile by shifting the webs relative to one another. The webs of sheet material may be manually moveable or, alternatively, a motorized driving means may be employed to move the sheets automatically. Remote-control means may further be provided to activate the motor driving means from a point remote to the target system proper.

BRIEF DESCRIPTION OF THE DRAWING

FIG. 3 is an oblique drawing of an alternative embodiment of the invention more suited to a permanent or semi-permanent firing range application; and FIG. 4 is an oblique view of a gearing mechanism which may be used in conjunction with a motor drive to automatically misalign the sheets in web form relative to one another so as to provide a fresh set of parallel, co-extensive layers.

DETAILED DESCRIPTION OF THE PREFERRED EMBODIMENT

Figures 1, 1A, 2:
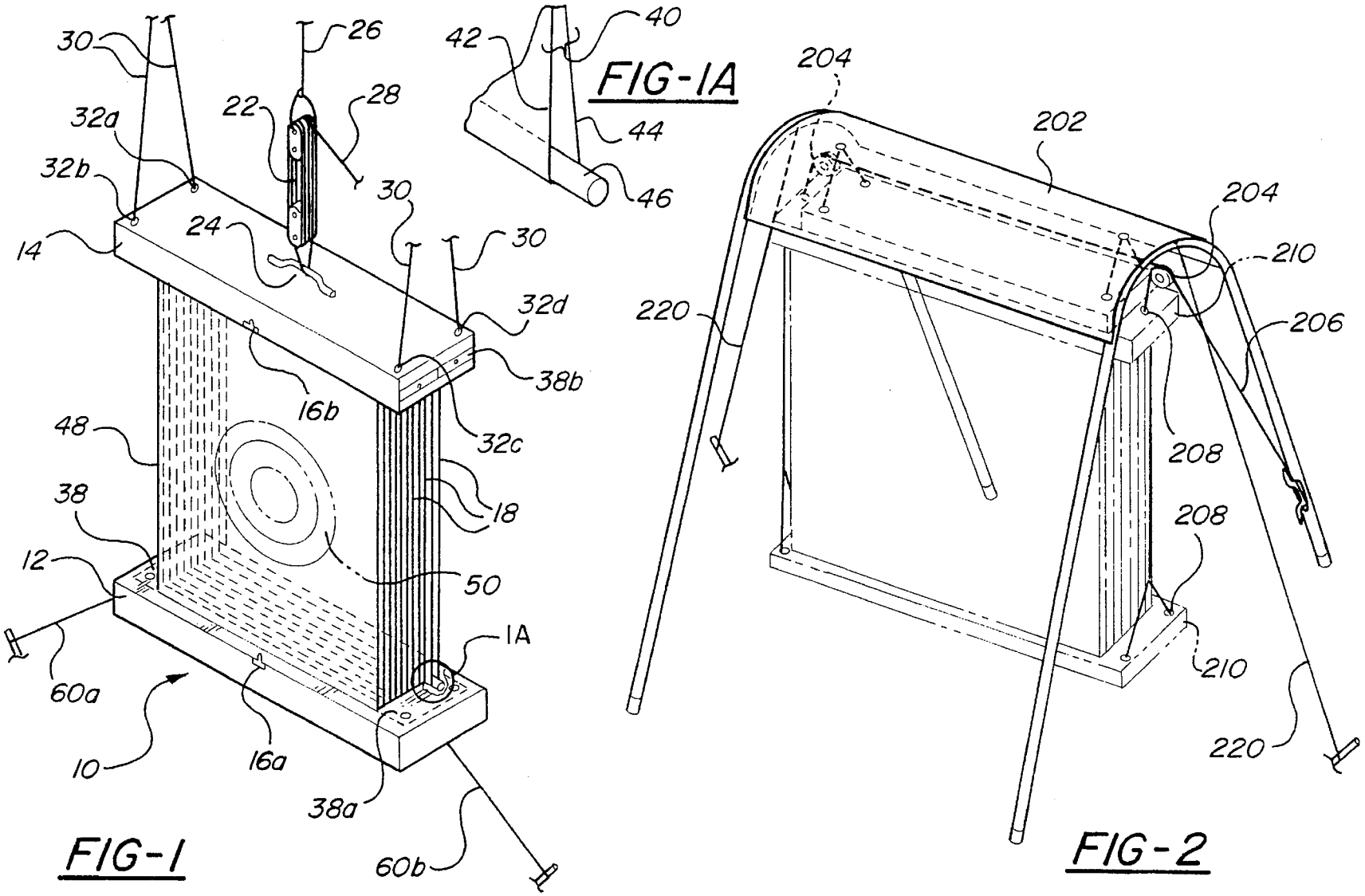
FIG. 1 an oblique drawing of a collapsible version of the present invention wherein the upper and lower portions may be joined to form a box-like structure into which the projectile arresting sheets may be entirely contained.
FIG. 2 is an oblique drawing of the collapsible version of the invention further including an optional stand and pulley means to assist in drawing the lower base portion up to the upper cover for closure and fastening.

The present invention is capable of halting and retaining low- and medium-force projectiles, including arrows fired from bows. The term "force" is used in lieu of references to projectile speed or velocity, since considerable confusion exists in the prior art with regard to the characterization of projectile speed and the units of measurement used. Although the present invention can be designed for higher-force projectiles, it is particularly suited to medium-force projectiles, including arrows fired from bows, which exhibit a striking force in the range of 100 foot-pounds. As the examples below will show, BB and pellet guns and slingshots deliver projectiles which are considered low-force in nature, with energies of approximately 20 foot pounds and below, whereas powder-driven projectiles are high-force in nature, exhibiting energies in excess of 125 foot-pounds even at small calibers.

The energy or force delivered by a projectile launched to the surface of a target may be calculated in foot- pounds according to the formula:

foot pounds of force=(projectile weight×velocity$^2$)/450,240

The following examples use this equation to calculate force for a variety of projectiles.

Example 1: 0.177 caliber pellet

Weight=7.73 grams

Velocity=1,000 feet per second

Force=(7.73×1,000$^2$)/450,240=17.2 foot-pounds

Example 2: 5.38 gram BB

Velocity=1,000 feet per second

Force=5.38×1,000$^2$/450,240=11.9 foot-pounds

Example 3: 2117 arrow (circumference=21/64", wall thickness=17)

Weight shaft=12.02 grains per inch, length=29", shaft weight=348.58 grains

Veins, insent, knock=52.4 grains (estimated)

Field point=100 grains, therefore total weight=500 grains

Velocity=300 feet per second

Force=500×300$^2$/450,240=99.9 foot pounds

Example 4: 0.22 caliber bullet

Short weight=47 grains

Velocity=1,100 feet per second

Force=47×1,100$^2$/450,240=126.3 foot pounds

As can be seen from the above examples, BBs, pellets and sling-shot delivered projectiles can be considered low force, arrows can be considered medium force, and powder-driven projectiles can be considered high force. Assuming such projectiles retain what is considered to be standard weight, mass and velocity, force is a convenient measure of a projectile's characteristics and will be used herein throughout for the purposes of clarification, and to assist in distinguishing the present invention over the prior art.

Now making reference to FIG. 1, there is shown generally at 10 a collapsible version of a target system constructed according to the invention. The system consists of a lower base portion 12 and an upper cover portion 14 which may be brought together and engaged with fasteners 16*a* and 16*b*, which may be of varying or conventional design. Additional fasteners or hinges (not shown) may be distributed around the structure. The overall enclosure comprising base 12 and cover 14 is shown in its opened form and ready for use, with the top cover portion 14 being suspended from above with base 12 being held further below at a distance determined by sheets 18, which will be described in more detail subsequently. In this suspended ready for use form, all target components, including the base portion 12, are held suspended above the floor 20.

The preferred suspension means consists of a centralized hoisting mechanism, preferably in the form of block and tackle 22 which is connected to the upper cover portion 14 with a fastener 24 and which may be suspended from above with line 26. The end of Cord 28 of the block and tackle pulley system 22 is shown free to be pulled upon and released by a user. It is presumed that once the target as shown is hoisted to a desired height, line 28 will be tied down or otherwise secured to hold the system suspended.

Once hoisted to a desired height through block and tackle pulley system 22, secondary suspension means in the form of ropes or wires 30 attached at points 32*a* through 32*d* may then be fastened from above to further stabilize the target system at a desired orientation. Specifically, this secondary suspension means, which may be used independent of block and tackle system 22, is used to keep the top cover portion 14 parallel, to deter any twisting or side-to-side movement, and to facilitate a back-to-front rocking motion with respect to the user as indicated by double headed arrow 34. The significance of this motion will be described shortly. In any event, if block and tackle 22 had been used for the initial hoisting, it may be released once secondary lines 30 are secured.

Should the target be used in a field application, for example, by hoisting to a tree limb, stabilizing tethers 60*a* and 60*b* may be used instead of the secondary suspension means attached to points 32*a*–32*d*. Of course, nothing precludes the use of the stabilizing tethers 60*a* and 60*b* in conjunction with lines 30, depending upon the exact application and the extent to which target movement is to be retarded.

Sheets 18 form a plurality of coextensive parallel layers capable of stopping projectiles of up to medium-force, such as arrows, pellets, BB's and so forth, once the target is suspended as shown. In the case of an arrow, at least three phenomena may be responsible for the slowing and eventual halting of the projectile. The first factor is due to the puncture resistance of the layer itself which must be surpassed as the projectile passes therethrough. Obviously the energy of the projectile is diminished as it passes through each consecutive layer. This particular energy absorption mechanism applies whether the projectile is an arrow or a round/slug-shaped projectile. Other phenomena, however, are unique to arrows. For example, drag comes into effect as the arrow passes through each surface at which point the surface then folds back on to the shaft of the arrow as it proceeds through, further diminishing the energy of the arrow in concert with the puncture resistance as the arrow tip begins to penetrate a particular layer. As with the puncture resistance, this drag phenomenon accumulates with each layer penetrated by the arrow.

Another mechanism for slowing the projectile, unique to the present invention, arises from the fact that the target system hangs free, and each time the projectile moves through the layers, it has to push the weight of the target, further diminishing the kinetic energy of the projectile. In the case of an arrow, then, at least three of the phenomena just described may take part in its eventual halting, though other mechanisms may be at work as well, depending upon the exact design of the arrow tip, strike velocity, and so forth.

Although not shown in the drawings, the box-like structure depicted in FIG. 1 may further include one or more compartments to house equipment related to the firing of the projectile, for example a separate compartment to house arrows or to house a bow, or a single attached compartment to house both the box and arrows. Preferably, appropriate straps would be provided to hold these components in place as well as accessories such as stabilizers, and so forth, the interior of the compartment(s) being preferably foam-lined to protect the contents therein. Such compartments may further be removably secured to the box-like structure housing the target itself so as to provide a single unit for carrying with detachable components depending upon the desired application.

The preferred sheet material is of a flexible nature. Polyethylene or various other organic and inorganic flexible sheet films may be suitable for this purpose, including composite structures, embedded meshes, and so forth. In addition, materials such as Kevlar® may be substituted in the event that very high-force projectiles (i.e., bullets) are to be stopped.

Although sheets 18 may be non-movably secured above and below into the cover and base portions 14 and 12, respectively, in the preferred embodiment the sheets are formed as a series of continuous webs enabling the sheets to be shiftable with respect to one another, thereby providing a fresh complement of layers by misaligning punctures formed therethrough by previously fired projectiles. The rods may be replaced or removed via optional panels 38*a* and 38*b*.

The circular inset drawing 39 illustrates one embodiment involving such webs. In this inset drawing, two of the layers 18 are shown as forming one web 40 which, when the target is suspended from above, forms two of the coextensive parallel layers 42 and 44. This web 40 is preferably formed around two rods, one situated in the upper cover portion 14 and the second corresponding rod situated in the lower base portion 12 and shown in the inset drawing at 46. Preferably, these rods are rotatable about their longitudinal axes, though depending upon the friction of the sheets against the outer surface of the rods, such rotation may or may not be necessary. That is, the sheets might readily slide around their respective rod pairs. Additionally, although not shown in the figure, in an alternative embodiment the rods may be geared to one another, either in the cover portion 14 or base portion 12 so that only one of the sheets 42 or 44 need be pulled upwardly or downwardly to set all of the other webs and the sheet comprising them in motion for the purpose of puncture misalignment. A cranking device of some kind may also be used in conjunction with the gearing. Preferably, the outermost sheets 48 facing the user will include some form of target-related indicia 50.

The sheets 18, whether in continuous-web form or more permanently secured above and below, are sufficiently flexible that they may be folded up and entirely contained within the overall enclosure of the target system once the top portion and lower portions are brought together, resulting in a structure significantly less voluminous than the target in its expanded form for use, and which is more easily transportable in the trunk of a car, etc. Obviously handles and other carrying means, not shown, may be further provided on one or more of the outer surfaces of the enclosure. In terms of construction materials, the top cover and bottom base portions are preferably constructed of wood with brass corners and other features which may appeal to the typical marksman hunter, though a wide variety of other materials may be used for the enclosure, including metals and plastics.

FIG. 2 illustrates a stand which may be optionally provided to support the target system of FIG. 1 or any of the embodiments depicted herein, in the event that no overhead support is otherwise available. The preferred stand would include an upper roof-like component 202 and pulleys 204 which may be used in conjunction with ropes 206 attached at points 208 to hoist the lower section 210 from its lower position (shown in broken lines) to its upper position where it may be fastened to the upper portion 212 and protected underneath roof 202. Guy wires 220 may further be provided with this embodiment so as to stabilize the optional stand. In FIG. 2, stakes 224 are conveniently provided to which guy wires 220 may be attached.

FIG. 3 shows an alternative embodiment of the invention intended more for permanent or semi-permanent installation out-of-doors or in archery or firing range type applications. In this case, the upper rods or dowels 302 are held in place with two upper members, one on the right, 304, and one on the left, 306. Guy wires 308 are provided for suspension purposes. In order to hold the bottom set of corresponding rod pairs in an appropriate parallel, spaced-apart configuration, right and left brackets 310 are provided with each rod 302' extending therethrough, preferably within a bearing 320, a cotter pin 322 being used to contain the rod 302' from falling through. In such a configuration, the need for automatic shifting of the sheets in web form becomes even more desirable. Accordingly, a mechanism within housing 330 is provided, enabling the sheets to be shifted relative to one another either automatically, which will be described further with reference to FIG. 4, or manually, through a crank 340, or through a combination of motorized means and manual mechanisms, for example, in the event that the motor fails and an override is required. Additionally, in the case of the automatic shifting of sheets, a radio remote control unit 350 may be provided, with a separate hand-operated transmitter (not shown).

Continuing the reference to FIG. 3, straps 360 may optionally be provided on either side of the target as shown. These flexible straps preferably attach to rigid supports 362 which extend across the depth of the target on either side, with forward straps being attached at front points 362' and straps on the rear of the target being attached at rear points of these rigid members 362. The straps are attached to pulleys 364 in the front of the target and pulleys 366 at the rear of the target, the pulleys 364 being affixed to a forward rotatable horizontal rod 365, the rear pulleys 366 being affixed to a rearward horizontal rotatable rod 367. To place the target into a storage mode, these two rods 365 and 367, and their accompanying pulleys 364 and 366, are rotated so as to wind the straps 360 thereupon, causing lower support members 362 to rise, thereby folding the sheet members up in accordion-like fashion, resulting in a compact storage configuration as indicated by broken line 370. Once in this folded up configuration, a suitable cover may be wrapped around the folded sheets for protection and to keep the layers clean.

The rods 365 and 367 may be driven and operated in a number of ways. For example, a separate motor may be contained within the housing 330, which may be used to automatically shift the flexible sheets, other mechanisms within this housing being described further with reference to FIG. 4. Alternatively, the same motor used to shift the flexible sheets may be used to rotate the rods 365 and 367 and their accompanying pulleys, with a suitable solenoid or gear-shifting mechanism being used so that the motor may serve these dual purposes. As a further alternative, the rods 365 and 367 may be moved in manual fashion only, for example, with a separate crank or other such mechanism (not shown). In any event, rods 365 and 367 may move separately or together, in the same direction of rotation, or in opposite directions, and in the even that a motor drive is provided, movement of these rods may be carried out by a remote control, either separate or the same remote control unit used to move the sheets, if provided.

Also shown in FIG. 3, to the right, is another target shown generally at 380. It will be noted in this figure that a housing motor drive is not provided but, instead, a much more simplified structure is included, and the upper rods holding the sheets for both targets are coupled to one another. In this manner, two or more targets may be ganged together, with a single motor drive unit being used to move the sheets of a plurality of targets. The same motor, or a different driven mechanism, may additionally be used to pull up on the straps for each target and fold them into their storage-mode configurations. Depending upon the circumstances, a single motor drive may be used in conjunction with an entire range of targets, or for a subset of the targets in the range, or each target may have its own motor drive.

FIG. 4 shows one of several possible configurations which may be used for the automatic movement of webs to provide a fresh set of sheets with misaligned penetrations, ready for a new volley of projectiles. In the configuration shown in FIG. 4, a motor 402 is used to drive a shaft 404 which has a single long worm gear or a plurality of worm gears 406, each gear being in operative engagement with a toothed gear such as 408. In the preferred embodiment of this automated version, the toothed gears are of a different diameter respecting each rod or dowel, so that with a single turn of shaft 404 each such gear 408 turns through a different number of degrees, as shown by the curved arrows of varying size, which, in turn, causes the sheets to move at different rates and distances relative to one another, thereby effectively eliminating the possibility that the sheets may realign themselves. These gears and other mechanisms, including the remote control 350, may be substantially protected by an outer removable housing shown by broken lines 420.

Although the preferred automatic shifting apparatus utilizes a worm-driven gear with toothed gears having different diameters, other alternatives are possible, including the use of dowels having different diameters, the webs being of slightly different lengths, or the use of two gears per dowel with one of the gears being an operative engagement with a dowel on one side, and the other gear being an operative engagement with the corresponding dowel on the other side of that gear.

Having thus described my invention, I claim:

1. A target system, comprising:

a plurality of sheets of flexible material connected to upper and lower frame members holding the sheets in spaced apart fashion to form a set of parallel, co-extensive layers;

means for suspending the upper frame member from above such that the target system is freely hanging, the lower frame member being flexibly suspended from the sheets, such that the layers slow or halt the projectile at least in part by the transfer of kinetic energy from the projectile to flexible motion of the sheets and corresponding motion of the frame members.

2. The target system of claim 1, wherein the upper frame member is suspended to swing freely such that the entire target system swings when struck by a projectile.

3. The target system of claim 1, wherein the upper frame member is suspended at ends thereof to resist rotation.

4. A target system, comprising:

a plurality of sheets of flexible material;

means to hold the sheets spaced apart to form a set of parallel, co-extensive layers;

means to suspend the target system from above so that the layers halt a projectile fired transversely with respect thereto; and the means to hold the sheets spaced apart including an upper support and bottom support forming a box-like structure when brought together, with the sheets of flexible material being foldable for total inclusion therewithin.

5. The target system of claim 4, the box-like structure including a separate compartment to house equipment related to the firing of a projectile.

6. The target system of claim 4, the separate compartment being adapted to house a bow and arrows.

7. A target system, comprising:

a plurality of sheets of flexible material; means to hold the sheets spaced apart to form a set of parallel, co-extensive layers; and means to suspend the target system from above so that the layers halt a projectile fired transversely with respect thereto;

each sheet being in the form of a continuous web, the means to hold the sheets spaced apart including a plurality of parallel, spaced-apart elongated elements, each web enclosing an upper and a lower elongated element to form the set of parallel, spaced-apart co-extensive layers.

8. The target system of claim 7, each web being shiftable to enable a user of the target system to misalign punctures in the layers created by a previous firing of a projectile.

9. The target system of claim 8, the webs of sheet material being manually moveable.

10. The target system of claim 8 including motor driving means to move the sheets automatically.

11. The target system of claim 10, including remote-control means to activate the motor driving means from a point remote to the target system proper.

12. A target system, comprising:

a top support portion and a bottom support portion;

suspension means associated with the top support portion;

a plurality of parallel, spaced-apart rods associated with each of the top and bottom support portions, each rod associated with the top portion corresponding to a parallel, spaced-apart rod associated with the bottom portion, thereby defining a plurality of corresponding rod pairs; and a plurality of continuous webs of flexible sheet material, each web being disposed around a corresponding rod pair, the length of each web being sufficiently long that when the target is suspended from above by the top portion, the bottom portion is held spaced apart at a distance therebelow, the sheets of the webs forming a plurality of exposed, parallel, co-extensive layers capable of stopping a projectile fired transversely with respect thereto.

13. The target system of claim 12, the bottom support portion and a top support portion forming a box-like structure when brought together, the sheet material being foldable within the box-like structure for storage and transportation.

14. The target system of claim 12, the projectile being an arrow.

15. The target system of claim 12, the flexible sheets being composed of a plastic film.

16. The target system of claim 12, each web of flexible sheet material being moveable in conjunction with its corresponding rod pair, thereby enabling the user to shift the layers relative to one another so as to misalign previously formed projectile penetrations.

17. The target system of claim 12, the layer closest with respect to a user further including visual target-related indicia.

18. The target system of claim 12, the suspension means associated with the top cover portion including a primary, centralized point for hoisting; and a plurality of secondary points on the right and left sides of the top cover portion which may be used for stabilization subsequent to suspension using the primary, centralized point for hoisting.

19. An archery target, comprising:

a top portion intended for suspension from above during use of the target;

a plurality of flexible sheets, each sheet having a top edge secured proximate the top portion and means to hold the bottomsedge of each sheet in suspended fashion below the top portion but off the ground so that the sheets form a plurality of parallel, co-extensive layers capable of stopping a projectile penetrating the layers transversely;

wherein the layers are capable of stopping a projectile penetrating the layers through a combination of mechanisms, including the puncture resistance of each layer the drag resistance of each layer around the shaft of an arrow as it passes therethrough, and the swinging moment of the target as energy from the arrow is absorbed within the layers and redistributed.

20. The archery target of claim 19, wherein the top portion defining a first portion of a box, the means to hold the bottom edge of each sheet defining a second portion of the box, wherein the first and second portions may be entirely separated from one another or fastened together to form the box, all of the sheets being contained therein.

21. The archery target of Claim 20, at least one of the first or second portions of the box further including a compartment to house archery-related equipment.

22. A target system for stopping arrows and low to medium force projectiles fired therethrough, comprising:

a plurality of sheets of flexible projectile-slowing material arranged in spaced apart, co-extensive layers, the sheets having upper ends supported by suspension means, and lower ends connected to a base member suspended from the lower ends, such that the sheets slow or halt the projectile at least in part by the transfer of kinetic energy from the projectile to flexible motion of the sheets and corresponding motion of the base member suspended therefrom.

23. A free-hanging target system for stopping arrows and other low to medium force projectiles, comprising:

a freely suspended upper frame member;

a plurality of sheets of flexible material hanging from the upper frame member in spaced apart fashion to form a series of spaced force-absorbing layers;

a lower frame member suspended from lower portions of the flexible sheets, such that the moment of the lower frame member acts on the projectile through the sheets as the projectile impacts and penetrates the sheets to absorb energy and slow or stop the projectile.

24. The target system of claim 23, wherein the sheets comprise a plurality of continuous loop-type webs, and the upper and lower frame members include lateral rod members for attaching the webs to the upper and lower supports, the webs being longitudinally adjustable around the rods, such that the webs can be shifted relative to one another to misalign punctured areas.

25. The target system of claim 23, wherein the upper frame member is suspended from opposite ends thereof to resist rotation.

26. The target system of claim 23, wherein the upper and lower frame members include means for attaching one to the other to define a case with a storage volume, the sheets of flexible material being sufficient flexible to be folded and fully contained within the case when the frame members are brought together.

* * * * *